United States Patent [19]

Walker

[11] 4,383,141

[45] May 10, 1983

[54] CARRIER FOR GARMENT BAGS AND THE LIKE

[76] Inventor: Brooks Walker, 1280 Columbus Ave., San Francisco, Calif. 94133

[21] Appl. No.: 310,636

[22] Filed: Oct. 13, 1981

[51] Int. Cl.[3] ..... A45C 5/14

[52] U.S. Cl. ..... 190/18 A

[58] Field of Search ..... 190/18 A, 58 B; 280/47.26, 47.24; 16/115

[56] References Cited

U.S. PATENT DOCUMENTS

| | | | |
|---|---|---|---|
| 1,875,121 | 8/1932 | Olson | 16/115 UX |
| 2,621,980 | 12/1952 | Miller | 16/115 X |
| 3,192,004 | 6/1965 | Whitney | 190/58 B X |
| 4,030,768 | 6/1977 | Lugash | 190/18 A X |

*Primary Examiner*—Donald F. Norton

[57] ABSTRACT

A carrier for use with a garment carry-on bag is provided with an inner light weight frame connected at its upper end to an external handle and connected at its lower end to an external wheeled axle.

7 Claims, 6 Drawing Figures

CARRIER FOR GARMENT BAGS AND THE LIKE

This invention relates to a carrier particularly adapted for use with a garment carry-on bag of the type commonly employed by airplane passengers. As noted in the above cited applications, it is desirable for a passenger to be able to carry a garment bag onto an airplane and to hang the same in a wardrobe close to the seating area of the passenger. In this manner loading of the plane is speeded up since it is not necessary to delay passenger movement while folded bags are unfolded and opened to remove the usual chain and hook to permit hanging the bag. The same is true in reverse while unloading.

The type of flexible light weight garment bag presently being employed is usually adapted to be folded over on itself and carried by a central handle. However in most cases the garment bag is used at all times in its unfolded condition since it fits conveniently into the trunk of most automobiles and the contents are better preserved when the bag is retained in its unfolded elongated condition.

The main object of the present invention is to provide a wheeled carrier for use with a garment bag in an unfolded condition. This being the condition when hanging.

Another object of the invention is the provision of a garment bag carrier which is light weight and efficient in use.

Other objects and advantages will be apparent from the following specification and drawings.

Figure 1:
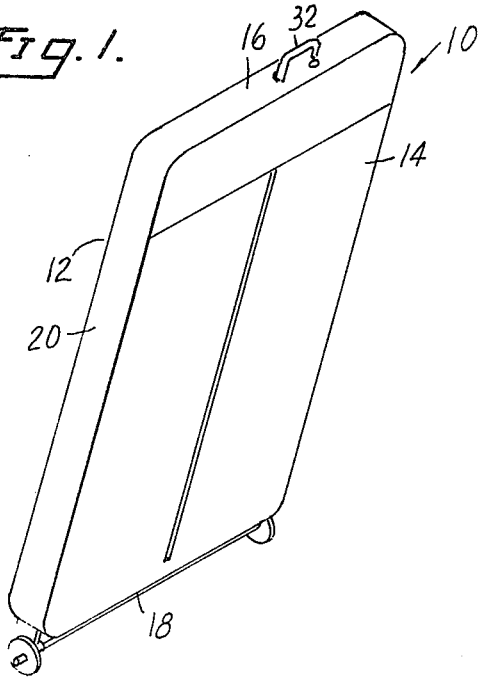
FIG. 1 is a perspective of a typical garment bag with the invention in use for transporting the bag on wheels.
Figure 2:
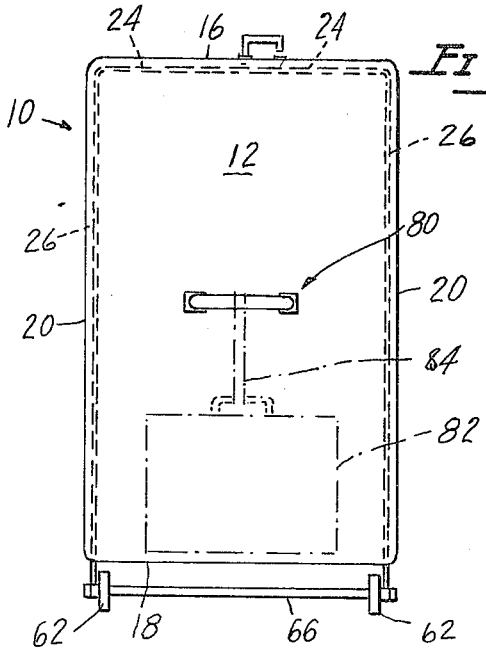
FIG. 2 is a front elevation of the side of the bag opposite that shown in FIG. 1.

In detail, the garment bag is shown generally at 10 in FIGS. 1, 2 and includes a front side 12, a rear side 14, a top side 16, bottom side 18 and longitudinally extending opposite side edges 20. The usual pockets on the front side of the bag are omitted from the drawings since they form no part of the invention and vary from bag to bag.

The bag is stiffened by an inner frame formed preferably of light weight spring steel rod. Said frame includes a transversely extending top portion 24 adjacent the top 16 of the bag and longitudinally extending side portions 26 adjacent the side edges 20.

Figure 3:
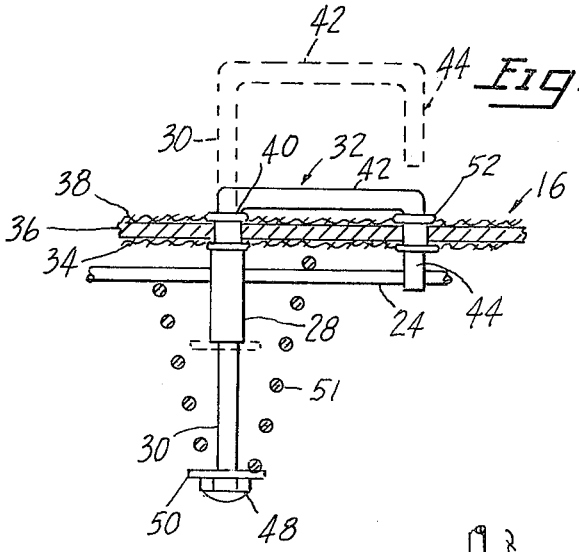
FIG. 3 is an enlarged fragmentary sectional view of the handle portion of the bag.
Figure 6:
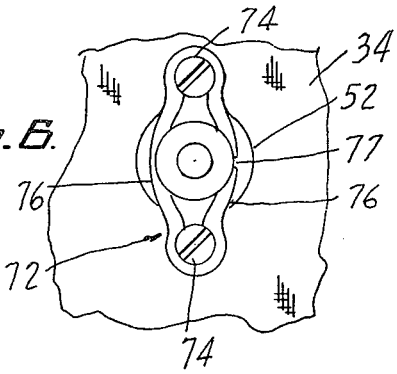
FIG. 6 is bottom view of the structure of FIG. 5.
Figure 4:
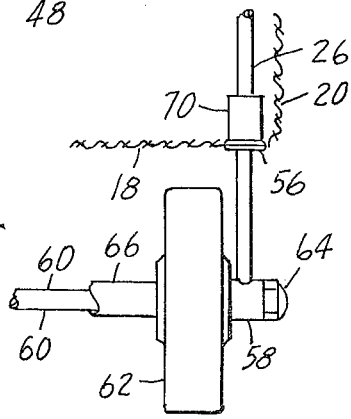
FIG. 4 is an enlarged fragmentary sectional view of a lower corner portion of the bag showing one of the two ground wheels.

Centrally of top portion 24 the same is rigidly connected as by welding or other suitable means to a sleeve 28 through which slidably extends the shank portion 30 of a handle generally designated 32 (FIG. 3). This handle extends through the inner layer 34 of fabric of the top 16, the usual top stiffener 36 of the bag, and through the outer layer 38. A grommet 40 may be conveniently employed to provide a through opening for this purpose.

The handle 32 shown in FIG. 3 is of the generally rectangular type which includes a horizontally extending portion 42 and a downturned terminal portion 44. A handle of this type is convenient for pulling the garment bag as shown in FIG. 1 and for hanging the bag from the top of a door as well as for hanging the bag on a wardrobe rod. The handle may be covered by a plastic sleeve to protect a door from damage.

Although the handle 32 may be fixedly secured to the sleeve 28 it is preferably slidably secured as shown in FIG. 3 so that it may be inserted into the bag with only the horizontal portion 42 projecting. By this structure the handle is prevented from snagging on projections while being transported in its flat condition.

One method of mounting the handle 32 is shown in FIG. 3 wherein the inner end of the shank 30 is threaded to receive a nut 48 for holding a washer 50 in place. Extending between washer 50 and the inside of the top 16 of the bag is a conical compression spring 51 which urges the handle inwardly at all times. In order to receive the downturned end 44 of the handle a suitable hole may be formed in top 16 by means of grommet 52. Outward movement of the handle 32 to the dotted line position of FIG. 3 is limited when washer 50 abuts the lower end of sleeve 28.

Each side portion 26 of the inner frame extends through a grommet 56 on bottom 18 of the bag and is fixedly secured to a sleeve 58 through which an axle 60 extends. A pair of wheels 62 are rotatably mounted on the axle 60 and the ends of the axle are preferably threaded for receiving nuts 64. It is preferable to provide an elongated light weight plastic tube 66 on axle 60 to act as a spacer between the wheels.

It is also preferable to provide a sleeve 70 on each side portion of the inner frame and to secure the sleeve to said side portion so as to put the bag under a slight longitudinal tension thus helping to preserve the shape of the bag.

Figure 5:
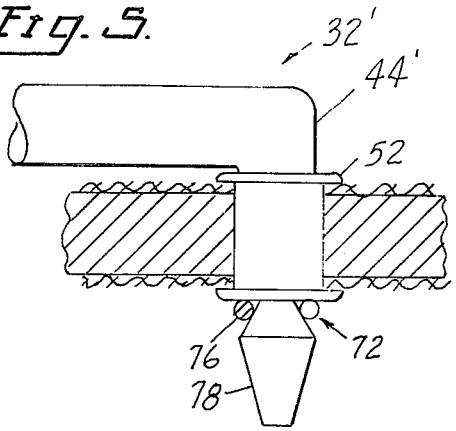
FIG. 5 is a greatly enlarged sectional view through the top portion of the bag showing a modified form of the handle.

Another means for securing the handle in its inner position is shown in FIG. 5. In this case the spring 51 of FIG. 3 is omitted and a light curved spring generally designated 72 is secured to the inner side of top 16 by means of screws 74 which are threaded into stiffener 36. Said spring 72 includes a pair of opposed sides 76 which may be deformed outwardly by the tapered lower end 78 of the downturned handle portion 44' of handle 32' as said handle portion 44' is pushed downwardly through grommet 52. If desired, the flexibility of spring 72 may be increased by cutting one of the sides 76 as indicated at 77.

The handle may be readily released from its stored position by pulling upwardly on horizontal portion 42.

As seen in FIG. 2 the handle 80 may readily be grasped by the user with the top of the bag under the user's arm when it is required to carry the bag instead of wheeling it as when ascending or descending stairs.

The diameter of wheels 62 is preferably no greater than the normal thickness of the garment bag when filled so as to minimize interference with other articles. However relatively large diameter wheels facilitate wheeling the bag over rough surfaces such as concrete while going between a parking lot and a terminal for example.

The above described structure lends itself to the transportation of additional items of luggage. For example, as seen in FIG. 2, a brief case 82, or other underseat luggage, indicated by dot dash lines in FIG. 2 may be secured to handle 80 by strap 84. By this arrangement the weight of the brief case is close to wheels 62 which is desirable.

I claim:

1. In combination with an elongated garment carry-on bag, a carrier for said bag comprising:

an inner frame including a pair of longitudinally extending side portions adjacent the longitudinally extending inner side edges of said bag, a transversely extending top portion of said frame secured to said side portions, a handle carried by said top portion and projecting through the top of said bag, the lower ends of said side portions of said frame extending through the bottom of said bag, and a wheeled axle secured to said lower ends.

2. A carrier according to claim 1 wherein said handle is slidably secured to said top portion and movable from an inner position substantially entirely within said bag to an outer projected position.

3. A carrier according to claim 2 wherein spring means holds said handle in said inner position.

4. A carrier according to claim 3 wherein said spring means is a compression spring for urging said handle toward said inner position.

5. A carrier according to claim 3 wherein said spring means engages the terminal portion of said handle.

6. A carrier according to claim 1 wherein said wheeled axle is parallel to the transversely extending bottom of the bag.

7. A carrier according to claim 6 wherein the wheels on said axle are spaced downwardly from said bottom when said bag is substantially vertical.

* * * * *